US005081051A

United States Patent [19]

Mattingly et al.

[11] Patent Number: 5,081,051

[45] Date of Patent: Jan. 14, 1992

[54] METHOD FOR CONDITIONING THE SURFACE OF A POLISHING PAD

[75] Inventors: Wayne A. Mattingly, Rio Rancho, N. Mex.; Seiichi Morimoto, Beaverton, both of; Spencer E. Preston, Portland, Oreg.

[73] Assignee: Intel Corporation, Santa Clara, Calif.

[21] Appl. No.: 581,292

[22] Filed: Sep. 12, 1990

[51] Int. Cl.[5] ..... B24B 1/00; H01L 21/302

[52] U.S. Cl. ..... 437/10; 437/228; 437/946; 51/325

[58] Field of Search ..... 51/325; 437/10, 946, 437/228

[56] References Cited

U.S. PATENT DOCUMENTS 4,213,277 7/1980 Fivian ..... 51/325

4,947,598 8/1990 Sekiya ..... 51/325

*Primary Examiner*—Olik Chaudhuri

*Assistant Examiner*—Ourmazd S. Ojan

*Attorney, Agent, or Firm*—Blakely, Sokoloff, Taylor & Zafman

[57] ABSTRACT

An improved method for conditioning the surface of a pad for polishing a dielectric layer formed on a semiconductor substrate is disclosed. In one embodiment, the serrated edge of an elongated blade member is first placed in radial contact with the surface of the polishing pad. The table and the pad are then rotated relative to the blade member. At the same time, the blade member is pressed downwardly against the pad surface such that the serrated edge cuts a plurality of substantially circumferential grooves into the pad surface. These grooves are dimensioned so as to facilitate the polishing process by creating point contacts which increases the pad area and allows more slurry to applied to the substrate per unit area. Depending on the type of pad employed, the number of teeth per inch on the serrated edge, the type of slurry used, etc., the downward force applied to the blade member in the rotational speed of the table are optimized to obtain the resultant polishing rate and uniformity desired.

18 Claims, 5 Drawing Sheets

METHOD FOR CONDITIONING THE SURFACE OF A POLISHING PAD

FIELD OF THE INVENTION

The present invention relates to the field of semiconductor processing; more specifically, to polishing methods for planarizing dielectric layers formed over a semiconductor substrate.

BACKGROUND OF THE INVENTION

Integrated circuits (IC) manufactured today generally rely upon an elaborate system of metallized interconnects to couple the various devices which have been fabricated in the semiconductor substrate. The technology for forming these metallized interconnects is extremely sophisticated and well-understood by practitioners in the art.

Commonly, aluminum or some other metal is deposited and then patterned to form interconnect paths along the surface of the silicon substrate. In most processes, a dielectric or insulative layer is then deposited over this first metal (metal 1) layer; via openings are etched through the dielectric layer, and a second metalization layer is deposited. The second metal (metal 2) layer covers the dielectric layer and fills the via openings, thereby making electrical contact down to the metal 1 layer. The purpose of the dielectric layer, of course, is to act as an insulator between the metal 1 and metal 2 interconnects.

Most often, the intermetal dielectric layer comprises a chemical vapor deposition (CVD) of silicon dioxide which is normally formed to a thickness of approximately one micron. (Conventionally, the underlying metal 1 interconnect are also formed to a thickness of approximately one micron.) This silicon dioxide layer covers the metal 1 interconnects conformably such that the upper surface of the silicon dioxide layer is characterized by a series of non-planar steps which correspond in height and width to the underlying metal 1 lines.

These step-high variations in the upper surface of the interlayer dielectric have several undesirable features. First of all, a non-planar dielectric surface interferes with the optical resolution of subsequent photolithographic processing steps. This makes it extremely difficult to print high resolution lines. A second problem involves the step coverage of the metal 2 layer over the interlayer dielectric. If the step height is too large there is a serious danger that open circuits will be formed in the metal 2 layer.

To combat these problems, various techniques have been developed in an attempt to better planarize the upper surface of the interlayer dielectric. One approach employs abrasive polishing to remove the protruding steps along the upper surface of the dielectric. According to this method, the silicon substrate is placed face down on a table covered with a pad which has been coated with an abrasive material. Both the wafer and the table are then rotated relative to each other to remove the protruding portions. This abrasive polishing process continues until the upper surface of the dielectric layer is largely flattened.

One key factor to achieving and maintaining a high and stable polishing rate is pad conditioning. Pad conditioning is a technique whereby the pad surface is put into a proper state for subsequent polishing work. According to traditional methods, pad conditioning involves scraping the upper surface of the pad using a flat edged razer or knife-type blade. This removes the old polishing compound (i.e., slurry) from the polishing path and impregnates the surface of the pad with fresh slurry particles. In other words, the scraping process helps to clear the old or used abrasive material off of the pad surface. At the same time, a constant flow of fresh slurry across the pad surface helps to impregnate the pad with new abrasive particles. In the past, this technique has been most successful when applied to the class of polishing pads which comprise relatively soft, felt-like materials (such as the Rodel-500 pad manufactured by Rodel, Inc.).

However, when used with other, relatively hard pads (such as the IC60 pad manufactured by Rodel) the conventional razor or knife blade technique produces unsatisfactory results. When used with this class of pads, the polish rate for the straight-edge blade drops precipitously as more wafers are processed, thereby reducing manufacturability.

As will be seen, the present invention provides a method for conditioning the surface of a polishing pad while improving the polishing rate by a factor of 30–50% over that achieved using prior art techniques. Moreover, this relatively high polishing rate is held constant over a large number of wafers resulting in increased wafer-to-wafer uniformity. The present invention also extends the pad life well beyond that normally realized with past conditioning methods.

SUMMARY OF THE INVENTION

An improved method for conditioning the surface of a pad utilized in the polishing of a dielectric layer formed on a semiconductor substrate is disclosed. Generally, this polishing process is carried out utilizing an apparatus which includes a rotatable table covered with the polishing pad, a means for coating the surface of the pad with an abrasive slurry and a means for forcibly pressing the substrate against the surface of the pad such that rotational movement of the table relative to the substrate results in planarization of the dielectric layer.

In one embodiment of the present invention, the serrated edge of an elongated blade member is first placed in radial contact with the surface of the polishing pad. The blade member is dimensioned so as to be at least as wide as the width of the path traversed by the substrate across the pad during the polishing process. Once the serrated edge of the blade is placed in contact with the pad surface, the table is rotated relative to the stationary blade member. Simultaneously, the blade member is pressed down against the pad such that the serrated edge cuts a plurality of substantially circumferential grooves into the pad surface. These grooves are dimensioned so as to facilitate the polishing process by creating point contacts at the pad/substrate interface. The grooves also increase the available pad area and allow more slurry to be applied to the substrate per unit area.

Of course, increasing the downward pressure applied to the serrated blade results in a much deeper penetration of the grooves into the pad. Depending on the type of pad employed, the number of teeth per inch on the serrated edge, the type of slurry used, etc., the downward force applied to the blade and the rotational speed of the table are optimized to obtain a desired polishing rate and uniformity.

By using this method of conditioning the pad, the polishing rate is increased to roughly 2,000Å per minute, an increase of approximately thirty to fifty percent over the best polishing rate previously achieved using prior art methods. In addition, this relatively high rate is held constant over a run of at least 200 wafers. Thus, the present invention produces a high polishing rate and good wafer-to-wafer uniformity.

BRIEF DESCRIPTION OF THE DRAWINGS

The novel features believed characteristic of the invention are set forth in the appended Claims. The invention itself, however, as well as other features and advantages thereof, will be best understood by reference to the detailed description that follows, read in conjunction with the accompanying drawings, wherein:

DESCRIPTION OF THE PREFERRED EMBODIMENT(S)

A process of conditioning a pad surface utilized in a semiconductor polishing process is disclosed. In the following description, numerous specific details are set forth, such as specific material types, thicknesses, temperatures, etc., in order to provide a thorough understanding of the invention. It will be obvious, however, to one skilled in the art that these specific details need not be used to practice the present invention. In other instances, other well-known structures and processing steps have not been described in particular detail in order avoid unnecessarily obscuring the present invention.

Figure 1:
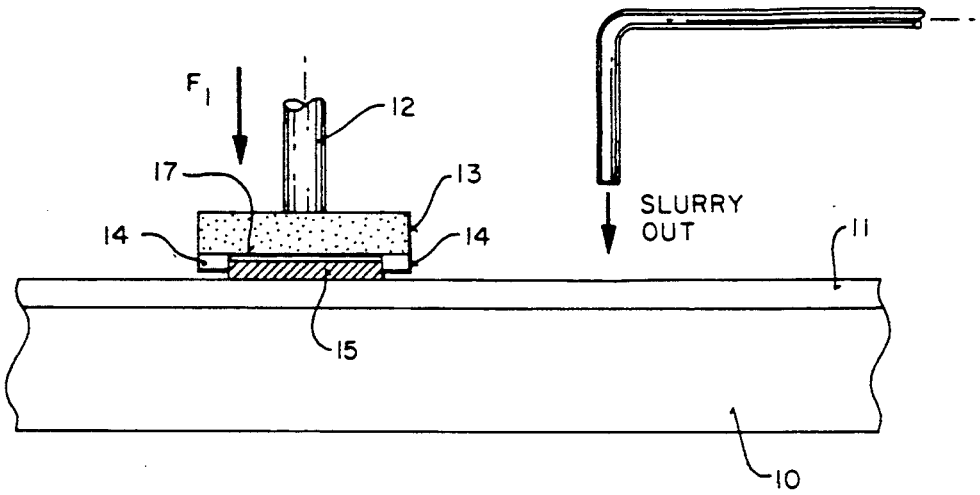
FIG. 1 illustrates the polishing apparatus utilized in accordance with the present invention.

With reference to FIG. 1, there is illustrated a polishing apparatus for planarization of a dielectric layer formed over a semiconductor substrate. During planarization, the silicon substrate 15 is placed face down on pad 11, which is fixedly attached to the upper surface of table 10. In this manner, the dielectric layer to be polished is placed in direct contact with the upper surface of pad 11. According to the present invention, pad 11 comprises a relatively hard polyurethane, or other material, capable of absorbing particulate matter such as silica or other abrasive materials. In the currently preferred embodiment of the present invention, a non-perforated pad manufactured by Rodel, Inc., known by the name "IC60", is employed. It is appreciated that similar pads having similar characteristics may also be conditioned in accordance with the invented method to achieve the beneficial results mentioned previously.

A carrier 13, also known as a "quill," is used to apply a downward pressure $F_1$ against the backside of substrate 15. The backside of substrate 15 is held in contact with the bottom of carrier 13 by a vacuum or simply by wet surface tension. Preferably, an insert pad 17 cushions wafer 15 from carrier 13. An ordinary retaining ring 14 is employed to prevent wafer 15 from slipping laterally from beneath carrier 13 during processing. The applied pressure $F_1$ is typically on the order of five pounds per square inch and is applied by means of a shaft 12 attached to the backside of carrier 13. This pressure is used to facilitate the abrasive polishing of the upper surface of the dielectric layer. Shaft 12 may also rotate to impart rotational movement to substrate 15, thereby greatly enhancing the polishing process.

During polishing operations, carrier 13 typically rotates at approximately 40 rpms in circular motion relative to table 10. This rotational motion is commonly provided by coupling an ordinary motor to shaft 12. In the currently preferred embodiment, table 10 also rotates at approximately 15 rpms in the same direction relative to the movement of the substrate. Again, the rotation of table 10 is achieved by well-known mechanical means. As table 10 and carrier 13 are rotated, a silica-based solution (frequently referred to as "slurry") is dispensed through pipe 18 onto the upper surface of pad 11. Currently, a slurry known as SC3010, which is manufactured by Cabot, Inc., is utilized. In the polishing process the slurry particles become embedded in the upper surface of pad 11. The relative rotational movements of carrier 13 in table 10 then facilitate the polishing of the dielectric layer. Abrasive polishing continues in this manner until a highly planar upper dielectric surface is produced.

Prior to starting the above-described polishing process, the surface of pad 11 is first conditioned in accordance with the present invention. As will be described in more detail shortly, conditioning involves forcibly pressing a serrated blade radially across the surface of pad 11. In doing so, the serrated blade imparts a series of substantially circumferential grooves across the portion of the pad over which polishing takes place. These concentric grooves allow slurry to be channeled under the substrate during polishing. The grooves also increase the pad area so that the combined effect is that the polishing rate is increased and better wafer-to-wafer uniformity is achieved. In addition, conditioning the pad by forming a plurality of concentric grooves extends the useful life of the pad material.

Figure 2:
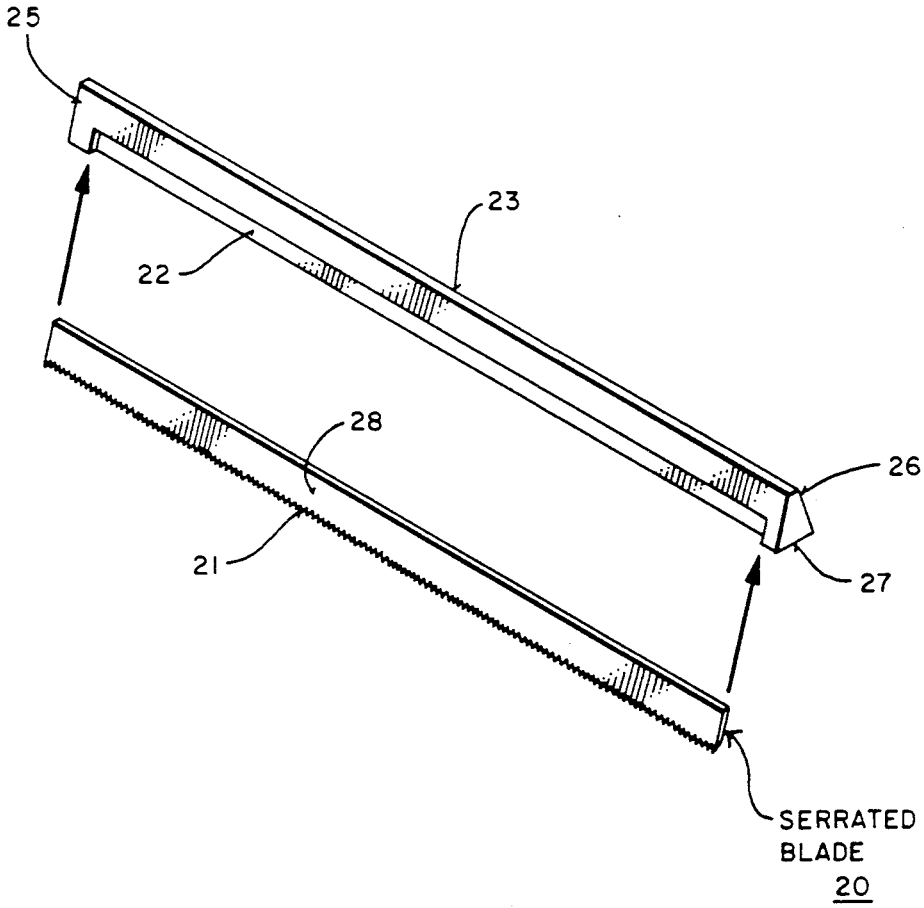
FIG. 2 illustrates the serrated blade member and one portion of the mounting block used in accordance with the currently preferred embodiment of the present invention.

Referring now to FIG. 2 there is shown a blade 20 having a serrated edge 21 and a front surface 28. In the currently preferred embodiment, serrated blade 20 comprises a molybdenum alloy. In other embodiments tungsten carbide, carbon alloys, or metals having similar properties may be employed. Preferably, serrated edge 21 has 18 teeth per inch. However, blades having anywhere between 18–32 teeth per inch have produced good results. In the currently preferred embodiment, each of the teeth of blade 20 comprise a triangular-shaped sawtooth having a serration depth of $0.036 \pm 0.002$ inches; the thickness of blade 20 is $0.024 \pm 0.001$ inches.

The length of blade 20 must be at least as wide as the width of the polishing path traversed by substrate 15 around table 10. For example, if substrate 15 is 6 inches wide then serrated blade is preferably manufactured to be about 7½ inches long.

When assembled, blade 20 fits into slot 22 of blade holder 23. Blade holder 23 comprises an elongated piece of machined metal (such as aluminum) which has a top surface 26 narrower than its bottom surface 27. In the preferred embodiment, top surface 26 is 0.085 inches wide and bottom surface 27 is 1¾ inches wide. This creates a front surface 25 which is beveled at an angle of approximately 70 degrees with respect to bottom surface 27. Serrated blade 20 fits into slot 22 such that the front surface 28 of blade 20 is substantially coplanar with front surface 25. In other words, slot 22 retains the same bevel as front surface 25. The height of blade 20 is such that the serrated edge 21 protrudes from the bottom of blade holder 23 when fully assembled.

Figure 3:
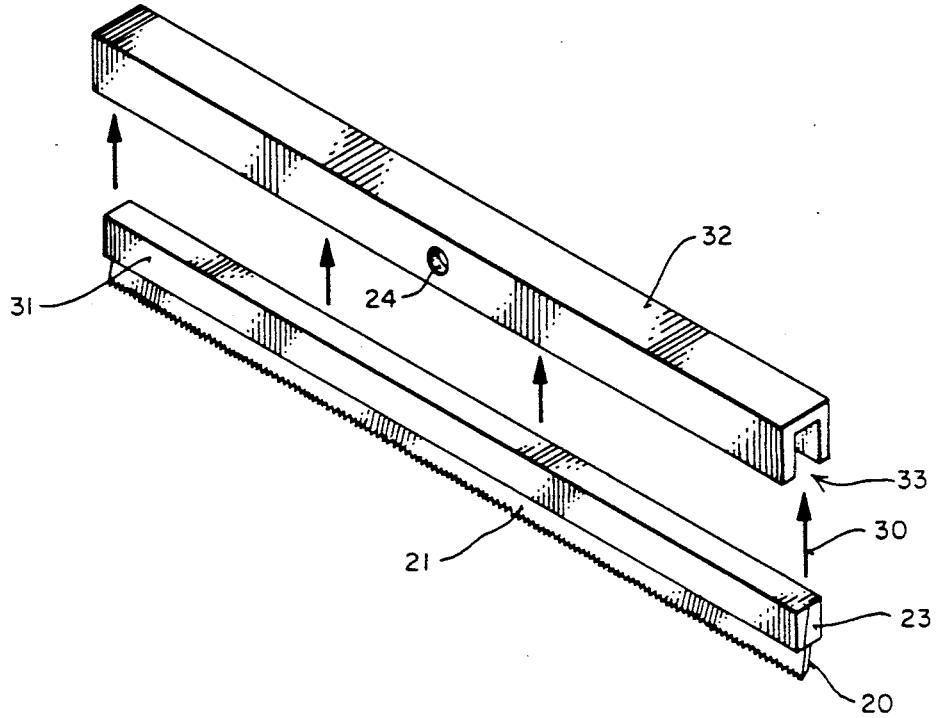
FIG. 3 illustrates the remaining portions of the mounting block used for mounting the serrated blade above the polishing pad during conditioning.

FIG. 3 shows the next step in the assembly process whereby front plate 31 is attached to blade holder 23 to secure blade 20 in place. Generally, blade 20 is slightly thicker than the depth of slot 22 such that when blade holder 23 and front plate member 31 are combined as shown in FIG. 3, a pressure is applied to blade 20 by the sandwich effect of members 23 and 31 to firmly hold blade 20 in place.

After blade 20 is sandwiched between blade holder 23 and front plate 31, the blade assembly is positioned within slot 33 of blade housing 32, as shown by arrows 30. Once again, housing 32 normally comprises a metal such as aluminum which has been machined so that slot 33 closely fits over the assembly consisting of blade holder 23 and front plate 31. Note that front plate 31 is machined with the same bevel as is blade holder 23 so that, when assembled, the combination is rectangular in shape—matched to fit within slot 33. Not shown in FIG. 3 are a series of screw holes which are tapped along the front of housing 32 approximately ¾ of an inch down from the top and which are spaced equally distant across the front of housing 32. The pressure applied by these screws is used to hold the blade assembly securely within slot 33. An opening 24 is drilled into the front of blade housing member 32 for accepting a screw head. This provides a means of attaching housing 32 to the arm assembly which is used to press serrated edge 21 into the upper surface of the pad 11.

Figure 4:
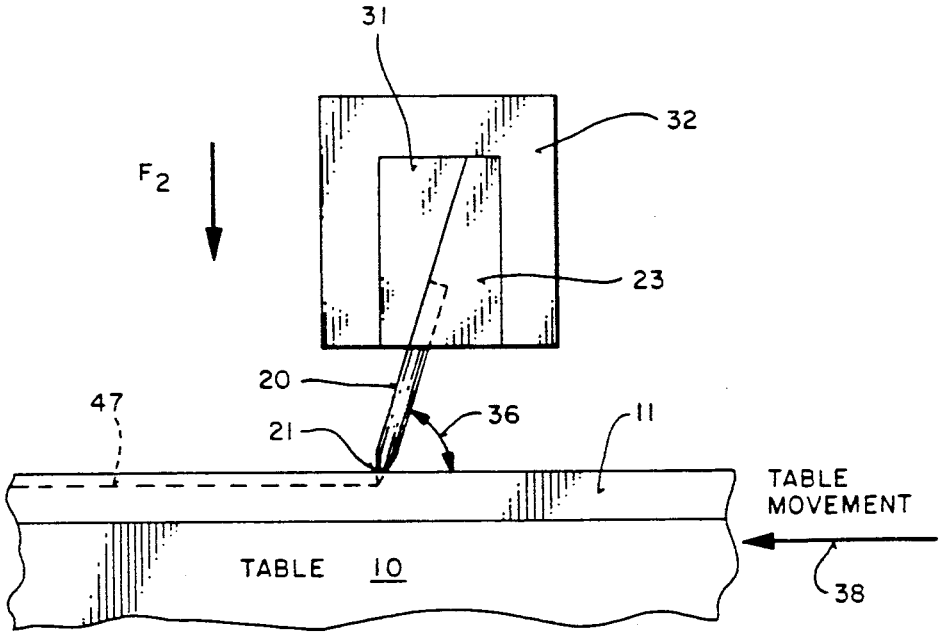
FIG. 4 is a side view of the serrated blade and mounting block assembly and their positions with respect to the pad and table assembly during conditioning of the pad.

FIG. 4 illustrates the side view of the blade assembly during conditioning of pad 11. Blade holder 23, front plate member 31 and blade housing 32 (screws not shown) function together to hold and maintain the position of blade 20 at a predetermined acute angle 36 with respect to the upper surface of pad 11. As previously mentioned, in the currently preferred embodiment, angle 36 is approximately 70 degrees. A downward force $F_2$ is applied to blade housing 32 via the arm assembly (to be described shortly) simultaneous with the rotational movement of table 10. The combination of force $F_2$ and the rotational movement of table 10 (as shown by arrow 38 in FIG. 4) allow the individual teeth of serrated edge 21 to cut a corresponding plurality of grooves 47 into the top surface of pad 11.

A key aspect of the present invention is the relative direction of angle 36 with respect to the rotational movement of table 10. Angle 36 must be acute with respect to the top surface of pad 11 when facing the direction of table movement 38. In other words, blade 20 is angled so as to drag across the top surface of pad 11 such that the tips of serrated edge 21 point away from the table movement 38. If the blade 20 were positioned to be perpendicular to the pad 11, or if it was positioned at an angle toward the rotational movement of table 10 (i.e. if angle 36 were greater than 90 degrees), then the pressure applied to the blade during conditioning would generally not be sufficient to prevent bouncing of blade 20 along the surface of pad 11. This bouncing effect would cause uncontrolled damage to the pad surface. Obviously, for these reasons any bouncing or vibrational movement of blade 20 is undesirable.

Figure 5:
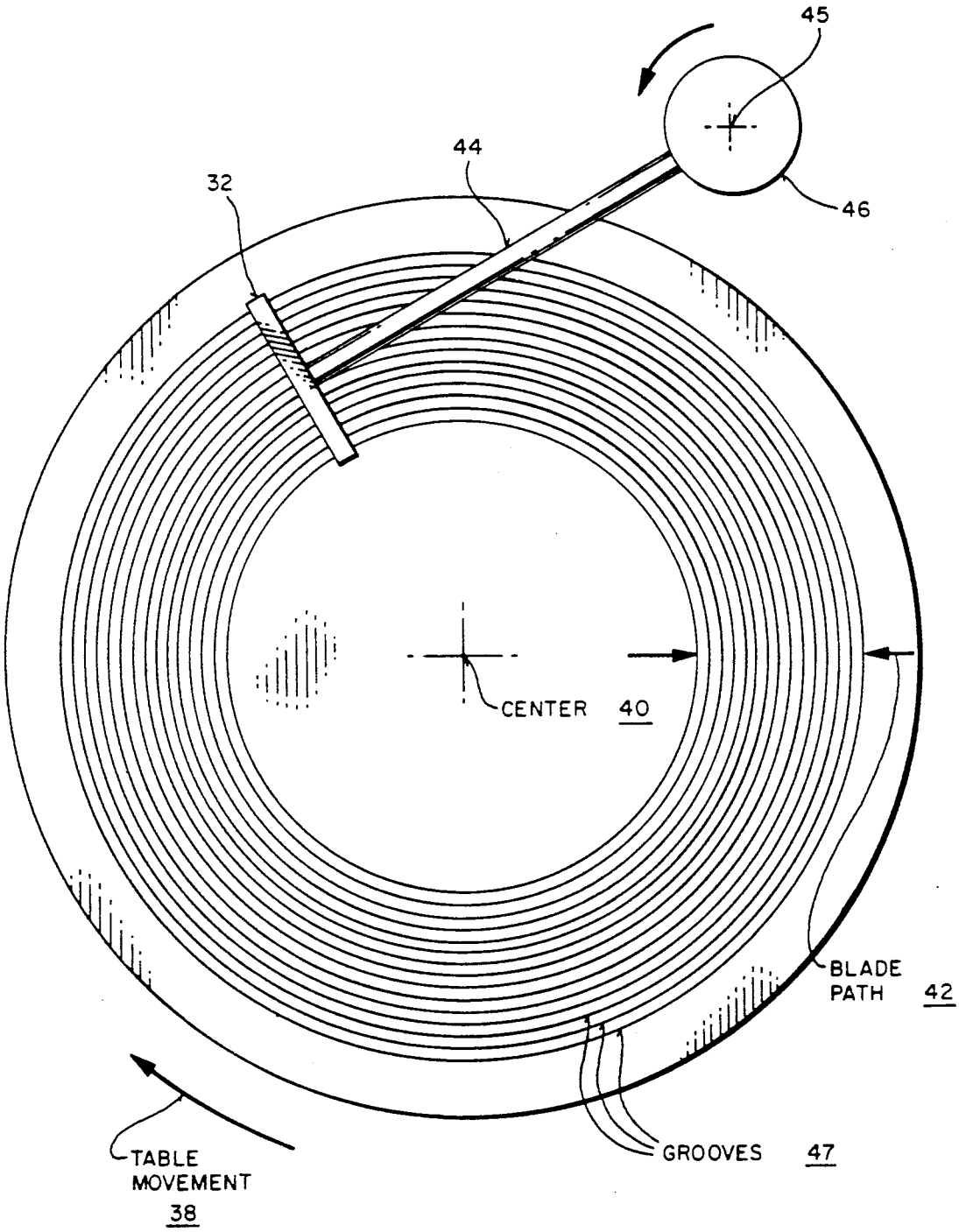
FIG. 5 is a top view of the apparatus of FIG. 1 illustrating formation of the circumferential grooves across the polishing pad using the serrated blade conditioning method of the present invention.

FIG. 5 shows a top view of the polishing apparatus of FIG. 1 during conditioning of the surface of pad 11. In FIG. 5, blade housing 32 is shown attached to the end of arm 44, which in turn is fixedly attached to hub 46. Hub 46 is rotatable about axis 45. Such rotation allows the serrated blade to be positioned directly over the polishing path portion of pad 11. The type of arm assembly (comprising hub 46, arm 44 and blade housing member 32) shown in FIG. 5 is often incorporated into most commercially available polishers. By way of example, a Westech 372 machine was modified to accept the serrated blade assembly of FIG. 3 in the currently preferred embodiment. Basically, the modification consisted of altering the motor gears used to rotate hub 46 such that blade 20 is held in a stationary position over pad 11. This allows the formation of a plurality of concentric rings or grooves 47 about the center 40 of pad 11 upon application of sufficient downward pressure on housing 32. Preferably, blade pressures (e.g. force $F_2$) in the range between 7 and 10 pounds is employed. However, it has been determined experimentally that blade pressures anywhere between 5 and 20 pounds will produce acceptable results. For a pressure between 7 and 10 pounds, the current pad conditioning time is approximately 2 minutes using a table rotation speed of between 10–30 rmps.

After conditioning has been completed, polishing of the substrates may proceed. Currently, a polish time of approximately six minutes is employed with a table speed of 15 rpms and a carrier rotational speed of approximately 40 rpms. It is imperative that the blade path 42 shown in FIG. 5 be wider than the width of the polishing path traversed by the substrates (see FIG. 6).

Further note that in generating the grooves 47 of FIG. 5, the serrated edge of blade 20 is installed such that the serrated edge of the blade points in toward the arm 44 so that arm 44 drags blade 20 while conditioning. This is consistent with the table movement indicated by arrow 38 and with the illustration of FIG. 4.

Figure 6:
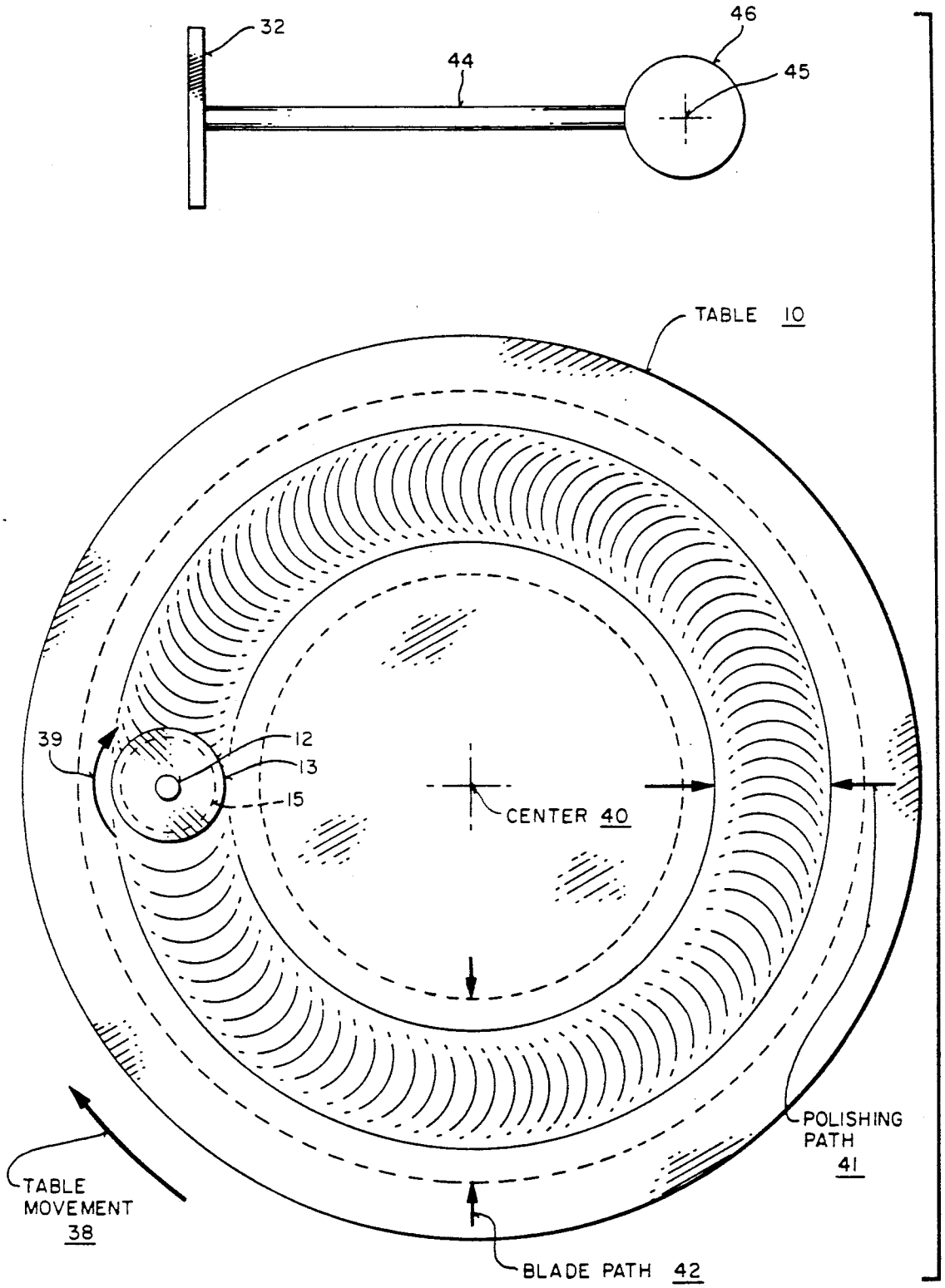
FIG. 6 is a top view of the apparatus of FIG. 1 illustrating the relative motions of the carrier and table during the planarization process.

With reference to FIG. 6, the actual polishing or planarization process is shown with hub 46 rotated such that arm 44 and blade housing 32 are no longer positioned over the surface of table 10. In FIG. 6, the relative rotation of movements of carrier 13 and table 10 are indicated by arrows 39 and 38, respectively. Note that in the currently preferred embodiment, carrier 13 remains in a stationary position relative to the center 40 of table 10. The portion of the pad surface (i.e. pad 11 covering table 10) utilized during polishing is depicted by polishing path 41. The dashed rings in FIG. 6 denote the blade path 40. It is appreciated that alternative embodiments may employ different means for rotating or moving substrate 15 relative to table 10 without departing from the spirit or scope of the present invention.

Figure 7:
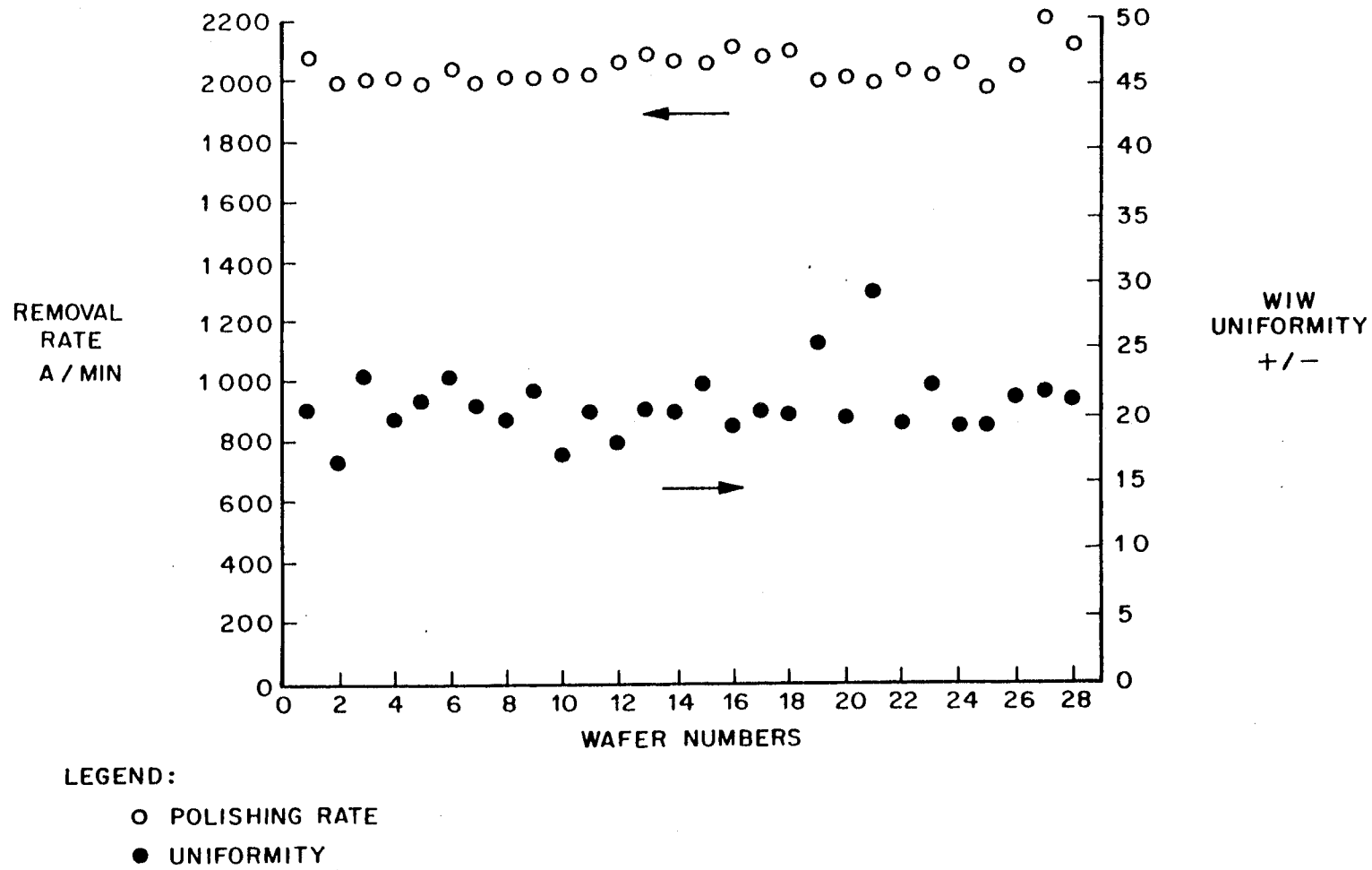
FIG. 7 is a plot of the polishing or removal rate and the wafer-to-wafer uniformity as a function of the number of wafers processed for a batch of wafers polished utilizing a pad conditioned in accordance with the teachings of the present invention.

A plot of the removal rate and uniformity versus the number of wafers processed is illustrated in FIG. 7 wherein each circle shown represents a single wafer. The results of FIG. 7 were produced by conditioning the pad for two minutes using a serrated molybdenum blade having eighteen teeth per inch. The pad was conditioned prior to the polishing of each individual wafer. The conditioning pressure was seven pounds for an IC60 Rodel pad. As can be seen, the polishing rate is highly repeatable on a wafer-to-wafer basis—consistently being above 2,000Å per minute. This is well beyond the 1,000Å to 1,500Å per minute industry accepted standard rate. The wafer-to-wafer uniformity for the group of wafers processed in FIG. 7 is generally about ±20% (three sigma). (A wafer-to-wafer uniformity of less than 15% (three sigma) is typically achieved.) Thus, a high polishing rate and consistantly high repeatability greatly increases the throughput of wafers processed in accordance with the present invention.

Although the present invention has been described in conjunction with the conditioning of one specific pad, it is appreciated that a present invention may be used with a great many different pads to achieve similar results. Therefore, it is to be understood that the particular embodiments shown and described by way of illustration are in no way intended to be considered limiting. The reference to the details of the preferred embodiment is not intended to limit the scope of the claims, which themselves recite only those features regarded as essential to the invention.

What is claimed is:

1. In a process for polishing a dielectric layer formed on the semiconductor substrate, said process utilizing an apparatus which includes a rotatable table covered with a pad, a means for coating the surface of said pad with an abrasive slurry, and a means for forcibly pressing said substrate against said surface such that rotation of movement of said table relative to said substrate results in planarization of said dielectric layer, a method of conditioning said surface to improve the polishing characteristics of said process comprising the steps of:

placing the serrated edge of an elongated blade member in radial contact with said surface of said pad, said blade member being at least as wide as the width of the path traversed by said substrate across said pad during said polishing process;

rotating said table relative to said blade member while simultaneously pressing said substrate against said pad such that said serrated edge cuts a plurality of substantially circumferential grooves into said surface, said grooves being dimensioned so as to facilitate said polishing process.

2. The method of claim 1 wherein said serrated edge of said blade comprises a plurality of triangularly shaped teeth numbering between 18 and 32 teeth per inch.

3. The method of claim 2 wherein said blade comprises a metal alloy selected from the group consisting essentially of:

molybdenum, tungsten carbide, or carbon.

4. The method of claim 3 wherein said serrated edge of said blade and the portion of said pad rotating toward said blade member form an acute angle.

5. The method of claim 4 wherein said acute angle is approximately 70 degrees.

6. The method of claim 5 wherein said rotating step lasts for approximately two minutes.

7. The method of claim 6 wherein said blade member is pressed against said pad surface with the pressure in the range of 5–20 pounds while said table rotates at a speed in the range of 10–30 rpms.

8. The method of claim 7 wherein said pad is of a type which is nonperforated.

9. In a polishing process utilizing an apparatus which forcibly presses a semiconductor substrate against a pad coated with an abrasive material, said pad in said substrate being set in relative movements to one another to facilitate planarization of a dielectric layer formed on said substrate, a method of conditioning the surface of said pad and comprising the steps of:

(a) placing a blade member having a serrated edge on said pad such that said serrated edge contacts said surface of said pad;

(b) rotating said pad relative to said blade member; and (c) forcibly pressing said blade member against said pad such that said serrated edge cuts a plurality of substantially circumferential grooves into said surface, said grooves being dimensioned so as to channel said slurry beneath said substrate during polishing, thereby enhancing the polishing rate and uniformity of said process.

10. The method of claim 9 further comprising the step of:

repeating steps (a)–(c) for the next substrate to be processed.

11. The method of claim 9 wherein said serrated edge of said blade comprises a plurality of triangularly shaped teeth numbering between 18 and 32 teeth per inch.

12. The method of claim 11 wherein said blade comprises a metal alloy selected from the group consisting essentially of:

molybdenum, tungsten carbide, or carbon.

13. The method of claim 12 wherein said serrated edge of said blade and the portion of said pad rotating toward said blade member form an acute angle.

14. The method of claim 13 wherein said acute angle is approximately 70 degrees.

15. The method of claim 14 wherein said rotating step lasts for approximately two minutes.

16. The method of claim 15 wherein said blade member is pressed against said pad surface with the pressure in the range of 5–20 pounds while said table rotates at a speed in the range of 10–30 rpms.

17. The method of claim 16 wherein said pad is of a type which is nonperforated.

18. The method of claim 17 wherein said blade member is at least as wide as the width of the path traversed by said substrate across said pad during said polishing process.

* * * * *